US006249222B1

(12) United States Patent
Gehlot

(10) Patent No.: US 6,249,222 B1
(45) Date of Patent: Jun. 19, 2001

(54) METHOD AND APPARATUS FOR GENERATING COLOR BASED ALERTING SIGNALS

(75) Inventor: Narayan Lal Gehlot, Sayreville, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/420,827

(22) Filed: Oct. 19, 1999

(30) Foreign Application Priority Data

Aug. 17, 1999 (MY) ..... PI 9903511

(51) Int. Cl.[7] ..... G08B 21/00

(52) U.S. Cl. ..... 340/540; 340/539; 340/825.44; 340/825.45; 340/825.46; 340/825.69

(58) Field of Search ..... 340/540, 539, 340/573.2–573.4, 825.4, 825.44, 825.45, 825.46

(56) References Cited

U.S. PATENT DOCUMENTS 4,975,694 * 12/1990 Laughlin et al. ..... 340/825.44
5,495,344 * 2/1996 Callaway, Jr. et al. ..... 358/407
5,552,779 * 9/1996 Gaskill et al. ..... 340/825.44
5,652,570 * 7/1997 Lepkofker ..... 340/573
5,793,304 * 8/1998 Sone ..... 340/825.44
5,841,352 * 11/1998 Prakash ..... 340/573
5,902,166 5/1999 Robb ..... 446/47
5,903,329 5/1999 Yoshida et al. ..... 349/106
6,032,024 * 2/2000 Makino ..... 455/38.4

* cited by examiner

*Primary Examiner*—Jeffery Hofsass
*Assistant Examiner*—Son Tang

(57) ABSTRACT

An apparatus for providing a color based alerting signal to a user to alert them to the occurrence of a predetermined event. The color based alerting device can be integrated into jewelry, garments, or a releasable strap and includes at least one color element that is visually observable by the user. Upon occurrence of the predetermined event, such for example as an incoming telephone call or page, the user is silently alerted to the event by a change in color of the visible color element. Subsequent action by the user, as for example answering of the incoming call or page, causes the color based alerting device to reset to its initial, non-alert color.

22 Claims, 7 Drawing Sheets

METHOD AND APPARATUS FOR GENERATING COLOR BASED ALERTING SIGNALS

BACKGROUND OF THE INVENTION

1. Field of the Invention

The present invention relates to alerting devices, and more particularly to color alerting devices for obtaining a user's attention upon the occurrence of an event.

2. Description of the Related Art

The use of wireless communication is increasing at an exponential rate, and as such there have been many attempts among service providers and manufacturers of the hardware implemented in wireless systems to provide options to the users that enable more convenient and more user friendly and discrete access to the available services. Among these attempts have been the implementation of alternative methods for alerting the user of the occurrence of a particular event, and more specifically the presence of an incoming communication signal. For example, with radio paging devices, the user generally has two options for setting the alert type when an incoming page is received: (i) an audible tone to indicate the presence of an incoming page, or (ii) a vibration mode to vibrate the device when an incoming page is received. The vibration mode of the radio pager serves the same function of seeking the user's attention when an incoming page is received but does so in a silent manner so as to not disturb the user or persons proximate the user when the page is received.

Some wireless telephones provide a similar vibration mode for indicating the presence of an incoming telephone call. The vibration mode has been implemented into these devices primarily to provide the user with the option of turning off the audible tones generated by the radio pager or wireless telephone so as to prevent inconvenient audible disturbances in a variety of different places, such as office meetings, libraries, movies, shows and any other place or circumstance that the user deems appropriate to eliminate the audible tones generated by the respective devices.

U.S. Pat. No. 5,861,686 to Lee discloses a device for generating waking vibrations or sounds. The device is implemented into alarm watches or in communications equipment such as cellular pagers or phones. The device utilizes an electromagnet, a coil and first and second sets of vibration members in a ring case. These elements are connected to a printed circuit board (PCB) of the device (e.g. watch, phone or pager) and, together, enable the selective generation of vibratory motion when the device receives an incoming call or, in the case of a watch, for implementing an alarm function.

U.S. Pat. No. 5,619,181 to Murray discloses a vibratory alerting device with audible sound generator. The alerting device simultaneously generates a vibration alert and an audible alert to notify the user as to the presence of an incoming call on a portable communication device such as a pager or wireless telephone.

As mentioned previously, the use of an audible alert signal can be undesirable when the user is located in a place or situation in which an audible alert signal might be considered an interruption. In addition, the devices used to implement a vibratory alert signal in a communication device are generally bulky in nature and have mechanical moving parts which require additional space within the device and thereby increase the size of the device. Furthermore, all of the existing alerting devices (e.g., audible and vibratory) are contained within the communication device (i.e., phone or pager) and therefor require the user to be carrying the same in order to receive the alerting signal.

It would be advantageous to provide a more discrete alerting device that is not physically connected or disposed within the user's communication device. This would enable the user to be alerted as to the presence of an incoming communication signal without requiring them to carry the communication device.

SUMMARY OF THE INVENTION

In accordance with an embodiment of the invention, a method for generating a color based alerting signal for alerting a user as to the occurrence of a predetermined event comprises the steps of: providing a color based alerting device having a color-variable element disposed in a location visually observable by the user; initializing the color based alerting device to a first predetermined color state; setting a color change limit for the color based alerting device; changing the color of the color-variable element to a second predetermined color state upon occurrence of the predetermined event; and resetting the color of the color-variable element from the second color state to the first color state when the user has responded to the occurrence of the predetermined event.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar elements throughout the views.

DETAILED DESCRIPTION OF THE PRESENTLY PREFERRED EMBODIMENTS

Figure 1A:
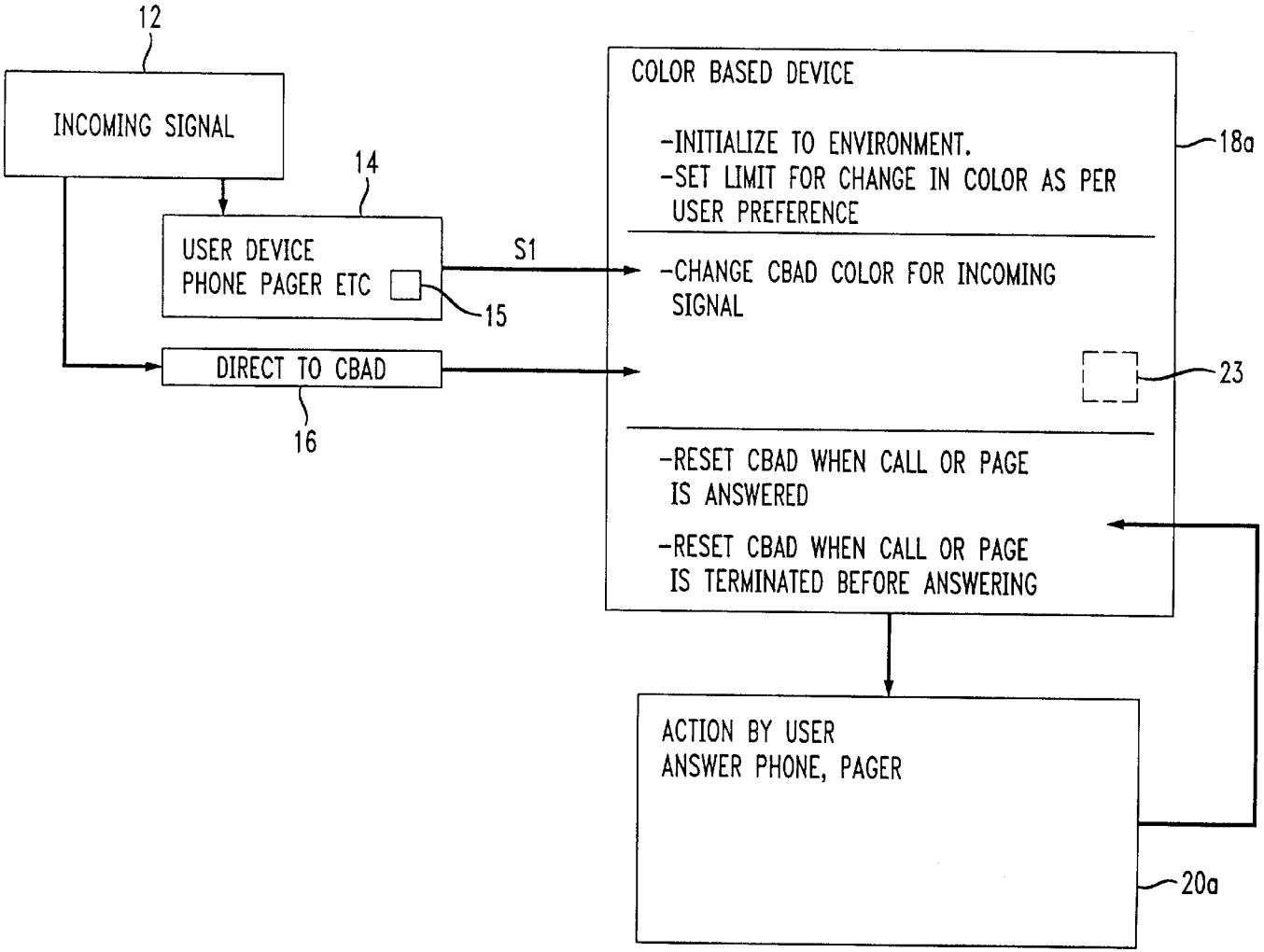
FIG. 1*a* is a diagrammatic representation of a method for generating color based alerting signals in accordance with an embodiment of the present invention.

A method for use in an illustrative apparatus shown in FIG. 1*a* of a color based alerting device according to a first embodiment of the present invention. An incoming signal 12 is received from an outside source and applied to the user device 14. The user device is a wireless device such as a pager, cellular telephone, or any other known apparatus or device that receives wireless incoming signals and alerts the user upon receipt of those signals. As explained hereinabove, this alert to the user is typically performed by providing an audible signal, or a mechanical vibration signal when an audible alert is not desired.

User device 14 is modified to include an inserting device 15 which disables the audible ringing or paging signal upon receipt of incoming signal 12 and generates at least one predetermined signal S1, or a set of predetermined signals S1, to activate color based alerting device 18*a*. Signal S1 can be a pulse width modulation (PWM) signal of a fixed predetermined frequency, or short pulses of the predetermined frequency. The frequency range for such signals can be, for example, 45–49 MHz, or 800 through 900 MHz ranges. Inserting device 15 may be, for example, an oscillator circuit of an allowable non-interfering frequency using a timer chip, and signal S1 can be generated with a simple LRC combination circuit or an IC timer circuit. The signal strength of S1 should be sufficient to reach the color based alerting device which may be attached to the user's body parts as needed.

Inserting device 15 is shown integrated into user device 14; however, it is also contemplated that inserting device 15 may be externally implemented by a separate connector capable of engagement with existing connectors on the user device, such for example, as the battery charger connection, an earphone for hands-free operation, and an IR port. According to one embodiment of the present invention, when incoming signal 12 is detected by user device 14, inserting device 15 disables the ringer and generates signal S1. In another embodiment, inserting device 15 operatively generates signal S1 in conjunction with the audible ringing of user device 14.

Figure 8:
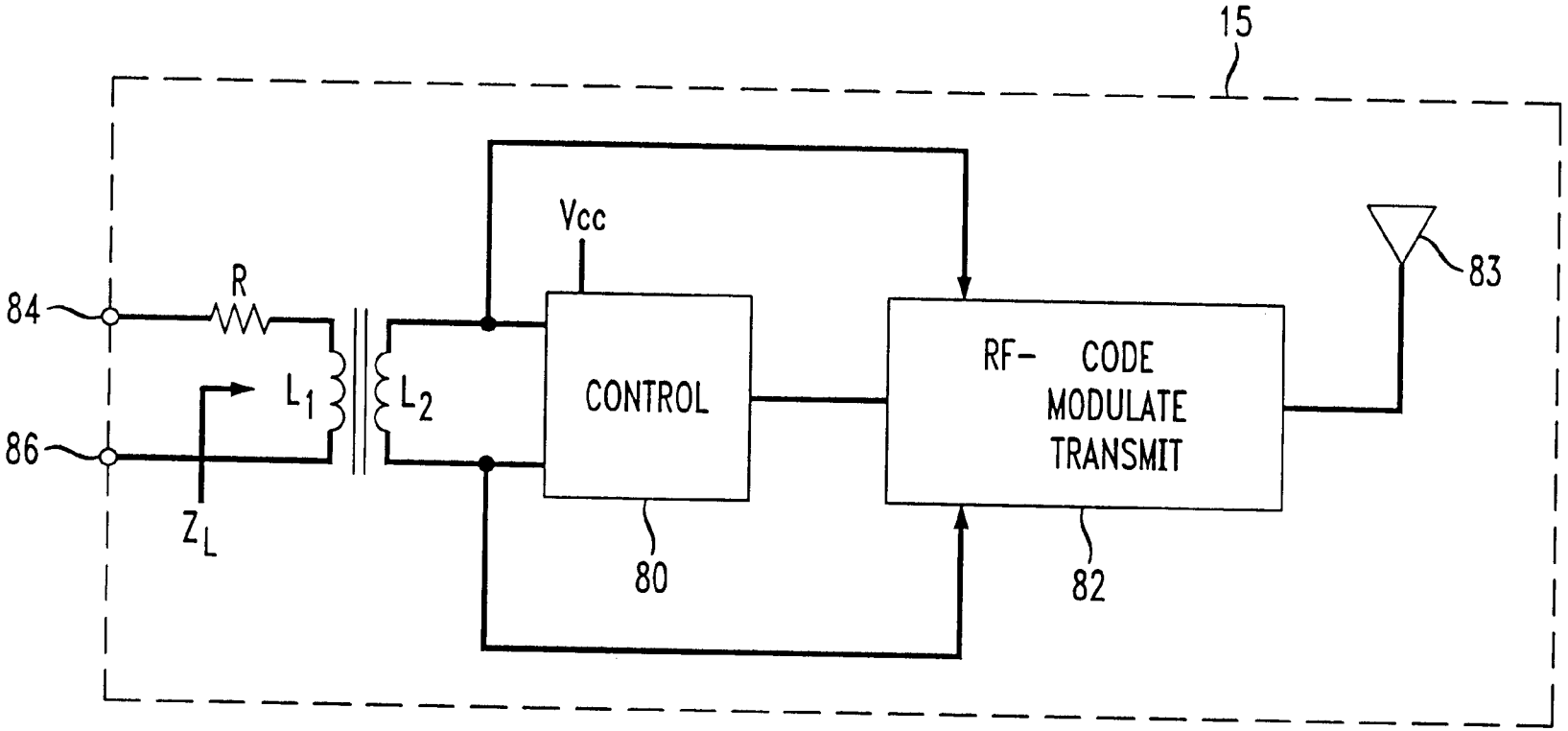
FIG. 8 is a schematic block diagram of the inserting device according to an embodiment of the present invention.

FIG. 8 shows an exemplary embodiment of inserting device 15 according to the invention. When incoming signal 12 is detected by user device 14, it is provided to inserting device 15 via terminals 84 and 86. The presence of the ringer current on terminals 84 and 86 causes an inductive coupling between inductors L1 and L2. Once coupled, the current flows to control 80 which electronically disables the ringer within user device 14 and further causes the RF device 82 to modulate and transmit control signal S1 via antenna 83 to the alerting device 18*a*. Control 80 can be any suitable known processing device. In another embodiment, control 80 can enable inserting device 15 to generate signal S1 in conjunction with the audible ringing of user device 14.

In an external example previously mentioned, terminals 84 and 86 can be mechanically coupled to an earphone jack of the user device. Generally, the mechanical coupling of a jack to the ear phone input of the user device will cause the same to mechanically disable the earphone speaker, and thereby disables the audible alert signal generated by the user device. Upon receiving incoming signal 12, the ringer current ordinarily broadcast through the earphone speaker will pass through the earphone jack and cause the inductive coupling of inductors L1 and L2 as described above. Thus, inserting device 15 can be added to user device that is not designed to incorporate the same.

In accordance with an embodiment of the present invention, a color based alerting device (CBAD) 18*a* is connected with the user device via a wireless connection, such for example, a radio frequency (RF) link. The CBAD 18*a* is external and separate from the user device 14 and includes at least one color-variable element 23 that is visually observable by the user and is initially set to a predetermined color or is colorless in the inactive state. During this initial setting of color-variable element 23, a color change limit may also be set during the inactive state. An example of a color change limit would be for a multi-color variable element capable of illuminating in different colors based on different user settings. An example of such device well known in the art is a multi-color LED capable of illuminating different colors based on current applied thereto. In the embodiment of FIG. 1*a*, when incoming signal 12 is received by user device 14, inserting device 15 disables the ringer or paging signal of the user device and sends a control signal S1 to the CBAD 18*a* to cause it to change the color of the associated color element. The color change to be displayed may be predetermined or set by the user prior to use of the CBAD 18*a*. For example, the color change can be a steady change from one color to another, or an oscillatory change where the color oscillated between two color states (e.g. on and off which would be from a colorless state to a colored state, or from one color to another).

Since the color elements 23 are visually observable by the user, when a color element is activated to either illuminate a colorless element or to change its existing color to another, the user is thereby alerted to the presence of incoming signal 12; the user can then answer the phone or page (20*a*). Once the user responds to the incoming signal by either answering the call or acknowledging the incoming page, the CBAD 18*a* resets itself back to its initially set color or colorless state. The external disposition of the CBAD 18*a* enables a more discrete alerting signal to be provided to the user, and provides the user with the option of not carrying the user device 14 and yet continuing to be notified as the presence of an incoming communication signal 12.

In another embodiment of the present invention, CBAD 18*a* is configured to directly receive 16 or share incoming signal 12 with the user device 14. Thus, upon receipt of an incoming signal 12, CBAD 18*a* can respond immediately as opposed to requiring that user device 14 provide a control signal S1 via inserting device 15 to CBAD 18*a* to indicate the presence of incoming signal 12. This alternate embodiment thus eliminates the need for the user device to send an RF signal to CBAD 18*a* after receiving an incoming signal 12, by enabling the simultaneous receipt of the incoming signal by both the user device 14 and the CBAD 18*a*.

Figure 1B:
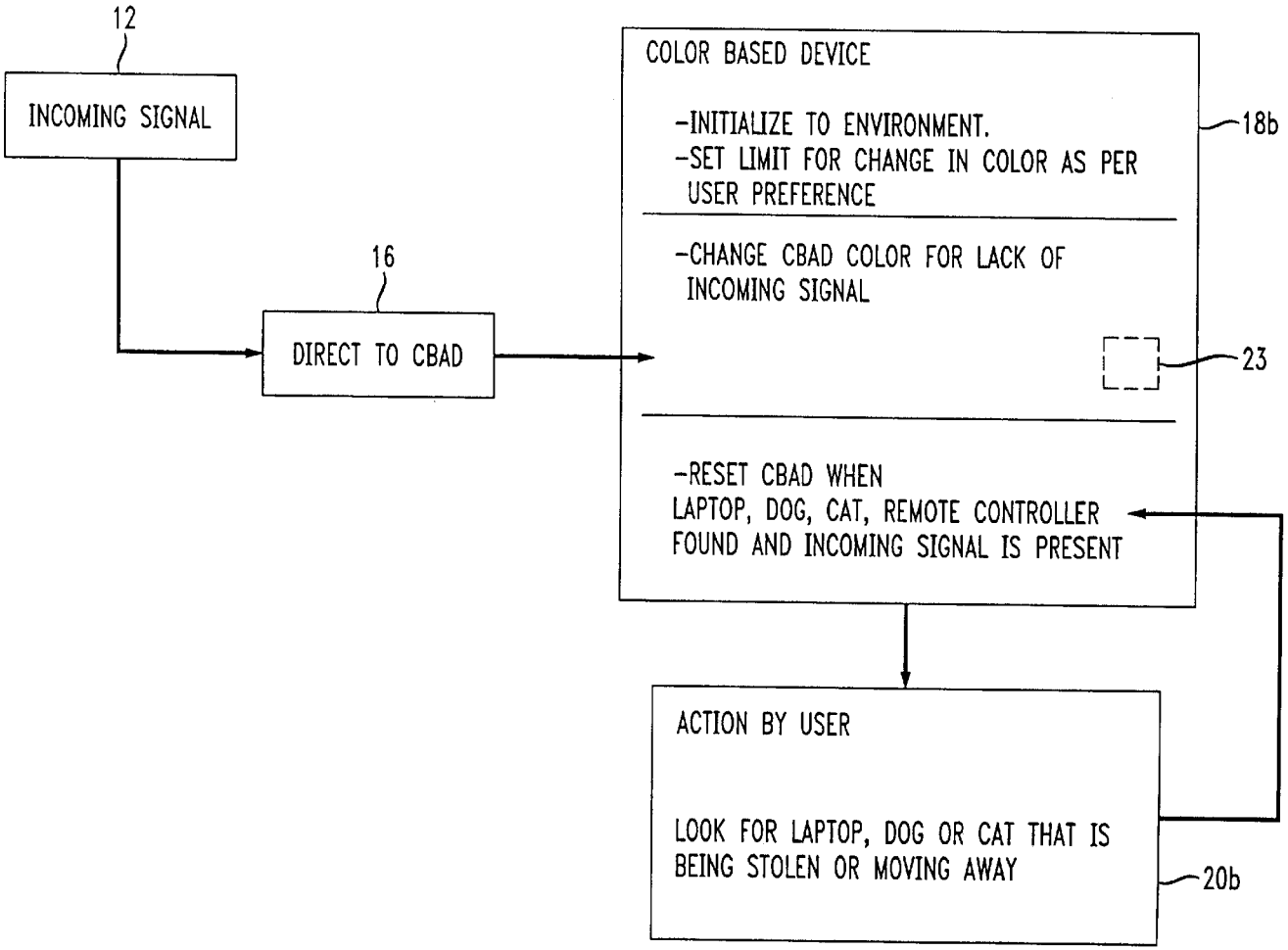
FIG. 1*b* is a diagrammatic representation of a method for generating color based alerting signals in accordance with another embodiment of the invention.
Figure 2:
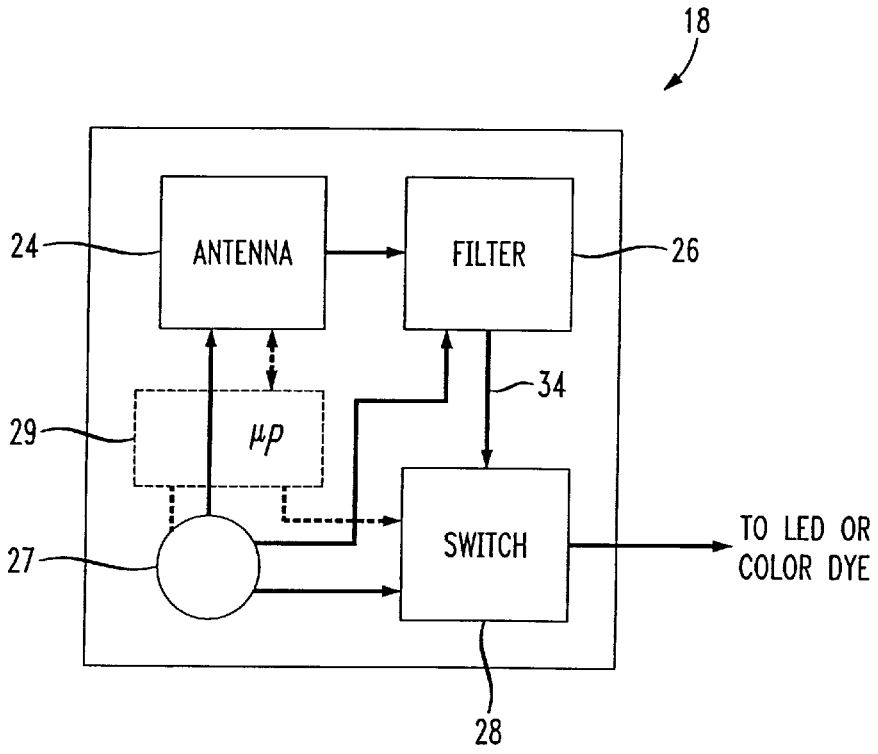
FIG. 2 is a block diagram of circuitry for a color based alerting device according to an embodiment of the invention.

FIG. 2 shows a block diagram of CBAD 18 according to an embodiment of the invention. CBAD includes an antenna 24 for receiving the incoming signal either from the user device 14 or directly 16 from the source of incoming signal 12. Antenna 24 is preferably a thin film antenna internally arranged within CBAD 18 so that the CBAD can be implemented in various different structures as discussed hereinbelow. The received incoming signal is filtered by filter 26 which is adapted to reduce noise in the operating bandwidth. The filtered incoming signal is then fed to switch 28 which activates a light emitting diode (LED), liquid crystal display (LCD) or a color dye capable of changing color when bombarded with a predetermined absorption spectra and which is disposed in visual contact with the user. Color elements and circuitry capable of changing color are well known in the art. Examples of such color elements and circuitry for enabling the changing of color of the same can be found in U.S. Pat. Nos. 5,902,166 and 5,903,329. Switch 28 may be, for example, a differential operational amplifier, or a relay or other electronic or mechanical switch for selectively passing battery power to the color element or corresponding circuitry to cause the same to change color. In other contemplated embodiments, CBAD 18 can include a microprocessor 29 that is connected to the antenna 24, battery 27 and switch 28 to operatively enable the monitoring functionality of the invention (discussed below with reference to FIG. 1*b*, 5*a* and 5*b*) by determining the cyclic or repetitive presence of an incoming signal and sending a control signal to switch 28 in the absence of an incoming signal 12.

A battery 27 is connected to a preamplifier (not shown) of the antenna 24, filter 26, microprocessor 29 and switch 28 to provide the necessary operating power to these devices and a current signal to the color elements 23 in response to the closing of switch 28 to cause a color element color change. Battery 27 is a miniature battery known in the art such as, for example, a solid state rechargeable thin film battery, a planar micro battery, lithium coin cells, thin film lithium battery, etc. The type of battery implemented and size thereof is a matter of design choice, and is dependent on the article in which alerting device 18 is incorporated.

Figure 3:
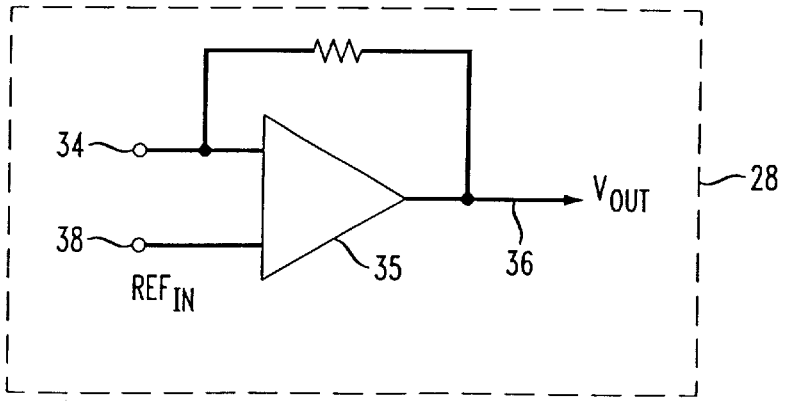
FIG. 3 is a schematic diagram of an operational amplifier implementation of the switch of the color based alerting device according to an embodiment of the invention.

FIG. 3 shows a schematic diagram of an exemplary operational amplifier configuration of switch 28. Operational amplifier 35 has a predetermined gain, a reference input 38 that is connected to a preset reference color signal to provide a reference input, and another input 34 that receives a control signal via filter 26 (FIG. 2). The input reference signal applied to reference input 38 may be, for example, a predetermined reference signal generated and/or stored by microprocessor 29, preset according to a particular design choice for a predetermined application, user set, or dynamically set by microprocessor 29 based (for example) on the ambient lighting in the user's surroundings. This dynamic setting by microprocessor 29 shows a monitoring aspect of this embodiment that enables CBAD 18 to be used and adjusted according to the surrounding environment. Upon receipt of the incoming signal or control signal in the form of a predetermined frequency in the form of pulses or a continuous signal via input 34, operational amplifier 35 provides an output current signal 36 that is fed to the color elements 23*a*, 23*b*, 23*c* (FIGS. 4 and 6*a*) to change the color of the same. When the signal applied to input 34 is discontinued, opamp 25 discontinues its current signal output, and the color element changes are deactivated. The discontinuation of the incoming signal result from the user answering the call or page, or the incoming caller terminating the attempted communication before the user answers the call.

Figure 4:
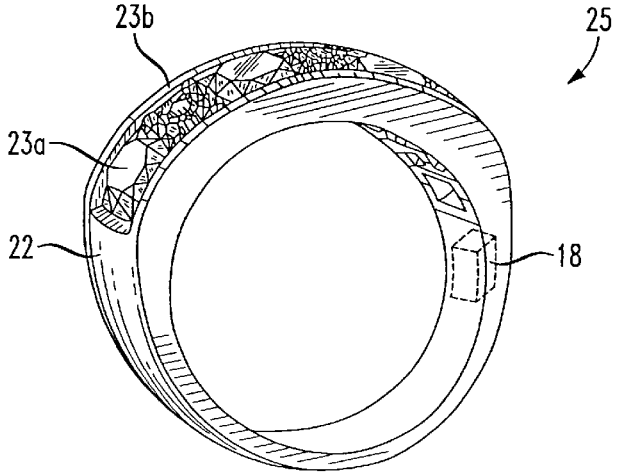
FIG. 4 is a perspective view of a jewelry ring implementing the device for generating color based alerting signals according to an embodiment of the invention.
Figure 6A:
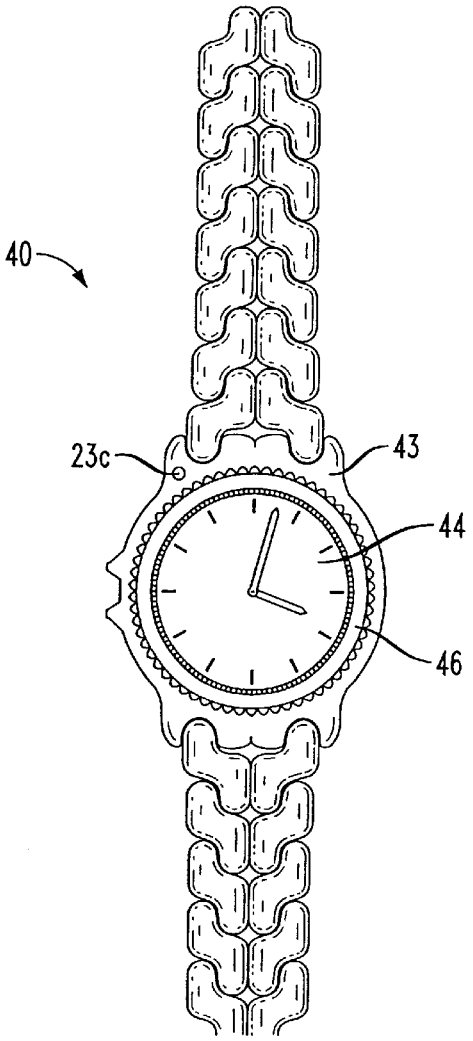
FIG. 6*a* is a top view of a wristwatch incorporating the device for generating color based alerting signals according to an embodiment of the invention.
Figure 6B:
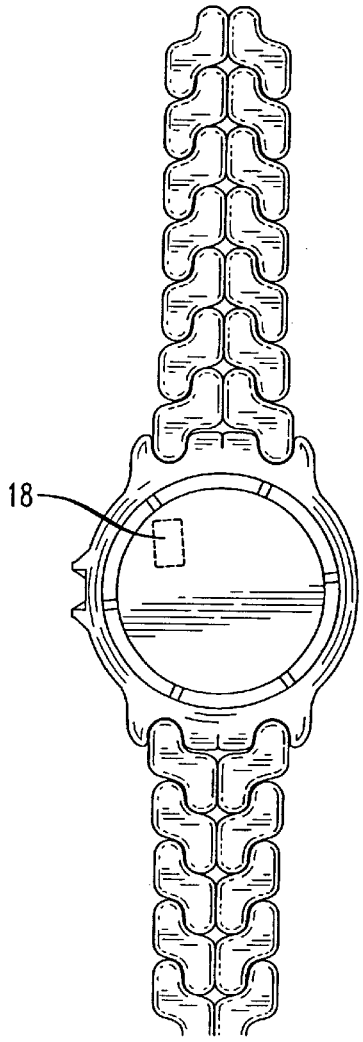
FIG. 6*b* is a bottom view of a wristwatch incorporating the device for generating color based alerting signals according to an embodiment of the invention.

Referring now to FIGS. 4 and 6*b*, the CBAD 18 can be implemented in or as part of numerous different and varied objects such as a jewelry ring 25 (FIG. 4) or a wristwatch 40 (FIG. 6*a*). In addition, it is contemplated that CBAD 18 may be a self contained device that can be removably fastened to different items or to a user's body. In the fixed position configuration, the size and shape of the object in which the CBAD 18 is implemented is a matter of design choice and left to the imagination of fashion and jewelry designers, for example. Other such objects that are contemplated by the present invention are finger rings, ear rings, bangle bracelets, shirts, pants, shoes, wrist watches, pocket watches, neck-ties, neck-tie pins, anklets, belt buckles, dress buttons, pens, necklaces, etc. In other contemplated embodiments, as for example for use with animals, the CBAD can be implemented in an animal's collar.

Shown in FIG. 4 is a jewelry ring 25 having the CBAD 18 implemented therein, and at least one color element 23*a* and/or 23*b* disposed on or proximate the outer surface thereof. Color elements 23*a*, 23*b* are connected to CBAD 18 and change color in response to an output current of CBAD 18 as explained above. Color element 23*a* can be an LED, INDIGLOW light, or color dye that changes color upon application of a predetermined absorption spectra that may be provided by an LED device. Other color dyes that change color in the presence of RF energy, or thermochromic materials that change color in response to changing temperatures may also be implemented as color element 23*a* without departing from the spirit of the present invention. In FIG. 4, color element 23*a* is shaped like a gemstone so as to provide a discreet appearance when not in use. In an alternative embodiment, color element 23*b* can be disposed on the upper surface of ring 25 using a color dye or a miniature LCD display. It should be understood that FIG. 4 is presented solely as an example of an implementation of a CBAD 18 in an article of jewelry, and that CBAD 18 may be incorporated in any article of jewelry or clothing without departing from the scope of this disclosure.

FIGS. 6*a* and 6*b* depict a wristwatch 40 having the CBAD 18 and at least one color element 23*c*, 44 and 46 implemented therein. FIG. 6*a* shows three examples of locations of a color element 23*c*, 44 and 46. Color element 42 can be an LED, LCD or color dye that is located remote from watch face 44 but disposed on watch body 43. In another embodiment, color element 46 can be disposed around face 44 and may comprise one or more LEDs, an INDIGLOW light, an LCD or a color dye. In yet another embodiment, watch face 44 may itself light up (INDIGLOW), or be formed of an LCD or one or more LEDs to provide a visible alert signal to the user in the presence of an incoming signal 12.

Figure 7:
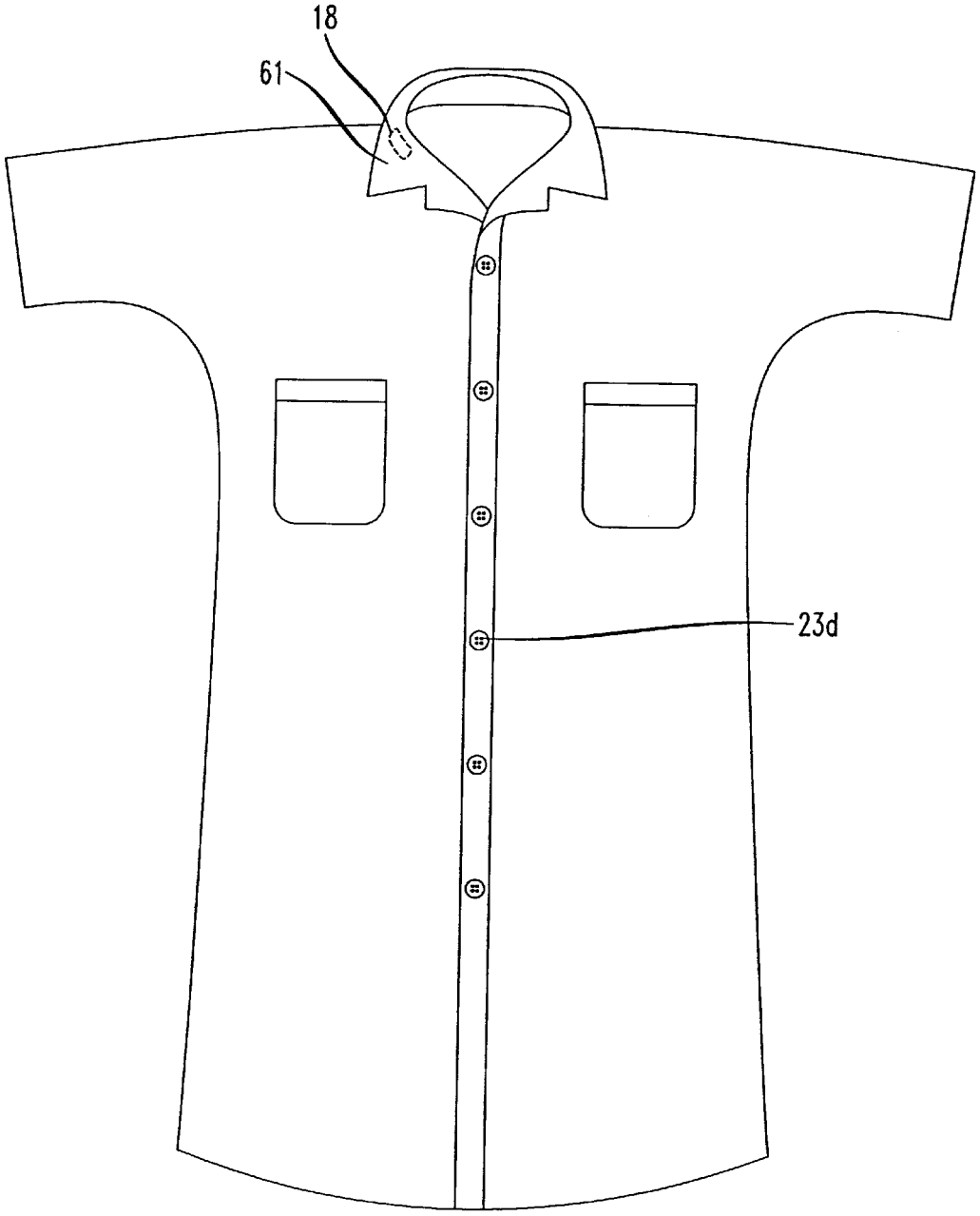
FIG. 7 is a front view of an article of clothing incorporating a color based alerting device according to an embodiment of the invention.

FIG. 7 shows an exemplary embodiment in which an article of clothing houses the color based alerting device 18 of the present invention. Shirt 60 has the color based alerting device 18 disposed under the collar 16 and the color element 23*d* embodied in one of the buttons, for example on a long sleeve cuff button or a cuff link. It should be understood that the location of CBAD 18 and color element 23*d* on the shirt 60 are shown here for exemplary purposes only, and that the actual location can change as a matter of design choice and/or user preference.

In a further embodiment diagrammatically shown in FIG. 1*b*, CBAD 18*b* may also be used to alert the user as to the presence, or more particularly to the absence of an object, animal or person. For example, a transmitter may be implemented to provide CBAD 18*b* with an RF signal on a cyclic or repetitive basis. In this particular embodiment, the user device 14 (FIG. 1*a*) is not required for communicating the presence or lack of presence of the incoming signal 12. As described previously, CBAD 18*b* can include a microprocessor 29 (FIG. 2) that enables monitoring of the presence of the RF signal (i.e. incoming signal 12). When the RF signal is not detected for a predetermined period of time (e.g. 1–30 seconds), CBAD 18*b* will alert the user by changing the color of the attached or associated color elements. Lack of detection of the RF (incoming) signal can for example be the result of movement of the object, person, or animal from which the transmission emanates beyond a predetermined range. Once the user has been alerted to the lack of detection of the incoming RF signals via a color change in the color elements 23*a*, 23*b* (FIG. 4) or color elements 23*c*, 44, 46 (FIG. 6*a*) the user can proceed to look for the transmitting device to determine its current location. When the user is or returns to within the transmitting range of the transmitting device, the CBAD 18*b* receives the RF signal and resets itself to its initial color or colorless state. Examples of contemplated objects for tracking are a portable computer, remote control devices, and any other readily movable object. This presence monitoring embodiment may also be used to monitor the presence or proximity of a child or animal provided with a transmitter 34 (FIG. 5*b*) that transmits the RF incoming signal 12 for monitoring by CBAD 18*b*.

Figure 5A:
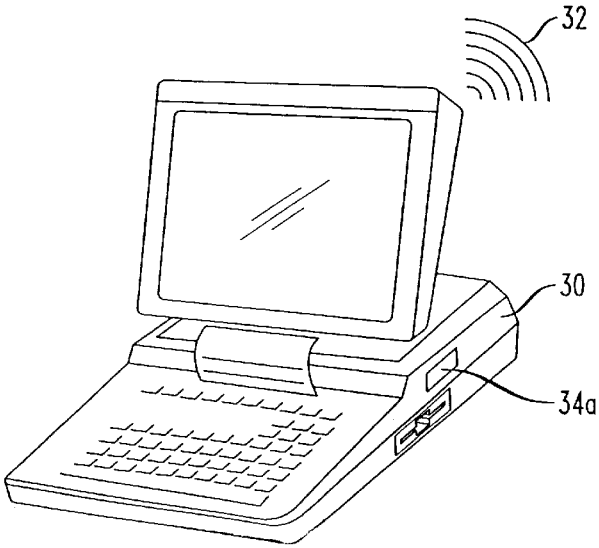
FIG. 5*a* is a perspective view of a computer as implemented into a device for generating color based alerting signals according to an embodiment of the invention.

Referring to FIG. 5*a*, a transmitter 34*a* is shown attached to a portable laptop type computer 30. Transmitter 34*a* can be externally attached to computer 30 or disposed internally so that it transmits RF signals 32 of a predetermined frequency and format (e.g. pulse, continuous, etc.) that CBAD 18*b* is adapted to receive. The transmission of signals 32 can be intermittent or cyclic based on a predetermined timing scheme. In this embodiment, CBAD 18*b* is operative to receive the intermittent or cyclic signals and only generates a current signal to activate the color elements when the intermittent or cyclic signals are not received for a predetermined period of time. Through the transmission of RF signals at predetermined time periods (e.g. every second), CBAD 18*b* performs a monitoring function and alerts the user when the RF signals cease to be detected due to absence of the object, person or animal being monitored.

Figure 5B:
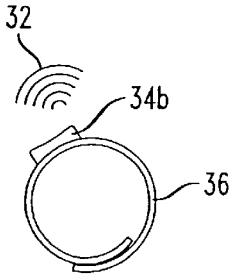
FIG. 5*b* is a plan view of a releasable strap having a transmitter for use in the generation of color based alerting signals according to an embodiment of the invention.

FIG. 5*b* shows a strap 36 having a transmitter 34*b* mounted thereon. Strap 36 can be releasably attached to an object, child or animal so as to provide a mobile embodiment of the transmitting signals 32 to the CBAD 18*b*. Thus, when the transmitter 34*b* is attached to an animal or a child via strap 36, the owner or person watching after the animal or child can monitor their presence within a specified range of the transmitter 34*b* and CBAD 18*b*. In this embodiment, CBAD 18*b* is implemented as before either in a piece of jewelry, on clothing or in a releasable device worn by the user, and the transmitter 34*b* can be attached in any convenient fashion to an object, animal, or person to be monitored.

It is thus contemplated that CBAD can be incorporated into many different known and common articles and items whose size and shape can be suitably configured to accord with the desired application. Examples of these items include any and all types of jewelry such as finger rings, earrings, necklaces, bracelets and wrist watches; clothing such as hats, caps, shirts, pants, shoes, shoe soles and socks; and other articles such as pens and pencils. In such a monitoring embodiment, the CBAD 18 can be configured for portability to facilitate its releasable transfer from one source or body to another, such as a pet or child.

While there have shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A method for generating a color based signal for alerting a user as to the occurrence of a predetermined event, comprising the steps of:

providing a color based alerting device having a color-variable element disposed in an article customarily worn on the user's person and in a location visually observable by the user;

initializing the color based alerting device in an inactive condition to a first predetermined color state;

setting in the inactive condition a color change limit for the color based alerting device;

changing the color of said color-variable element to a second predetermined color state different from the first color state upon occurrence of the predetermined event; and resetting the color of said color element from the second color state to the first color state when the user has responded to the occurrence of the predetermined event.

2. The method set forth in claim 1, wherein said predetermined event comprises receipt of an incoming communication signal from an outside source and said user response comprises answering of the incoming communication signal.

3. The method set forth in claim 2, wherein said incoming communication signal is designated for receipt by one of a wireless telephone and a wireless paging device.

4. The method set forth in claim 3, further comprising the step of generating a wireless control communication signal for transmission by the one of the telephone and paging device to the color based alerting device for activating the color-variable element to change its color from the first color state to the second color state.

5. The method set fort in claim 2, further comprising the step of applying the incoming communication directly to the color based alerting device to cause it to change the color of the color-variable element from the first color state to the second color state.

6. The method set forth in claim 1, further comprising:

providing a transmitting device remote from the color based alerting device for transmitting wireless communication signals on a predetermined repetitive basis; and monitoring at the color based alerting device for receipt of the transmitted wireless communication signals;

the predetermined event comprising the step of determining an absence of receipt of the transmitted wireless communication signals for a predetermined period of time, wherein the user response comprises locating of the transmitting device such that the color based alerting device is within a transmitting range of the transmitting device.

7. The method set forth in claim 6, wherein the transmitter is provided so as to be releasably attachable to one of an object, a person, and an animal for enabling the user to monitor presence of the object, person or animal within the transmitting range of the transmitting device.

8. The method set forth in claim 1, wherein said step of providing comprises integrating the color based alerting device with the color-variable element into a piece of jewelry wearable by the user.

9. The method as in claim 8, wherein the piece of jewelry is no larger than a finger ring.

10. The method set forth in claim 1, wherein said step of providing comprises integrating the color based alerting device with the color-variable element into an article of clothing wearable by the user.

11. An apparatus for generating color based alerting signals to a user in response to remotely-originating incoming communication signals designated for a wireless communication device, comprising:

a color based alerting device having a power source, a switch element coupled to said power source and a color element coupled to said switch element and disposed in an article customarily worn on the user's person and so as to be visually observable by the user; and means for applying a control signal to said color based alerting device in response to a received incoming communication signal to cause said switch element to apply an activation signal to said color element to thereby cause a color change to said color element as a result of the applied activation signal and thereby alert the user to receipt of the incoming communication signal.

12. An apparatus in accordance with claim 11, wherein said color based alerting device further comprises an antenna for receiving one of the incoming communication signal and said control signal.

13. An apparatus in accordance with claim 12, wherein said means for applying comprises an inserting device for operable connection with the wireless communication device and for generating said control signal in response to the received incoming communication signal and disabling an audible alert signal normally produced by the wireless communication device in response to an incoming communication signal.

14. An apparatus in accordance with claim 13, wherein said color based alerting device further comprises a microprocessor connected to said switch element for controlling the color based alerting device.

15. An apparatus in accordance with claim 14, wherein said control signal comprises the incoming communication signal is received by said antenna and defines said control signal, and said microprocessor is operable to cause said switch element close in response to receipt of incoming communication signal.

16. An apparatus in accordance with claim 14, wherein said switch element comprises an operational amplifier having a signal input for receiving said control signal, a reference input, and an output for outputting said activation signal to said color based alerting device.

17. An apparatus in accordance with claim 16, wherein said microprocessor is operable to provide a reference signal representing a reference color for application to said operational amplifier reference input.

18. The apparatus as in claim 12, wherein said wireless communication device includes an earphone jack for disabling an internal loudspeaker and routing audible signal to an earphone, and wherein said means for applying comprises a plug for insertion into the earphone jack so as to intercept said audible signal and generate said control signal in response thereto.

19. The apparatus as in claim 11, wherein the article customarily worn on the user's person is a piece of jewelry no larger than a finger ring.

20. An apparatus for generating color based alerting signals to alert a user to occurrence of a predetermined event, comprising:

a color based alerting device having a power source, a switch element coupled to said power source and a color element coupled to said switch element and disposed in an article customarily worn on the user's person and so as to be visually observable by the user;

transmitting means remotely disposed relative to said alerting device for transmitting communication signals to said color based alerting device on a repetitive basis; and means for controlling said switch element to close and thereby activate said color element in response to a failure of said alerting device to receive the incoming communication signals for a predetermined period of time.

21. An apparatus in accordance with claim 20, wherein said switch element is operable, when closed, to apply a current signal to said color element to cause said color element to change color in response to the applied current signal and thereby alert the user to absence of the incoming communication signals.

22. The apparatus of claim 20, wherein the article customarily worn on the user's person is a piece of jewelry no larger than a finger ring.

* * * * *